US006109953A

United States Patent [19]

Hashigaya et al.

[11] Patent Number: 6,109,953

[45] Date of Patent: Aug. 29, 2000

[54] SOCKET PLUG

[75] Inventors: Kazuya Hashigaya; Kazutami Oishi, both of Shizuoka, Japan

[73] Assignee: Koito Manufacturing Co., Ltd., Tokyo, Japan

[21] Appl. No.: 09/241,152

[22] Filed: Feb. 1, 1999

[30] Foreign Application Priority Data

Feb. 2, 1998 [JP] Japan ..... 10-020863

[51] Int. Cl.[7] ..... H01R 13/58

[52] U.S. Cl. ..... 439/457; 439/483

[58] Field of Search ..... 439/456–459, 439/470, 483

[56] References Cited

U.S. PATENT DOCUMENTS

| | | | |
|---|---|---|---|
| 2,042,398 | 5/1936 | Hile | 439/457 |
| 2,511,037 | 6/1950 | Bedoiseau | 439/459 |
| 3,981,555 | 9/1976 | Deurloo | 439/456 |
| 3,997,234 | 12/1976 | Worman | 439/456 |
| 4,752,241 | 6/1988 | Matsuoka et al. | 439/619 |
| 4,871,331 | 10/1989 | Kondo et al. | 439/736 |
| 5,154,645 | 10/1992 | Harada et al. | 439/736 |
| 5,664,870 | 9/1997 | Uchida et al. | 362/61 |

FOREIGN PATENT DOCUMENTS

| | | | |
|---|---|---|---|
| 0713998 A1 | 5/1996 | European Pat. Off. . | |
| 3216217 | 11/1983 | Germany | 439/470 |
| 1460730 | 1/1977 | United Kingdom . | |

*Primary Examiner*—Gary F. Paumen

*Attorney, Agent, or Firm*—Morgan, Lewis & Bockius LLP

[57] ABSTRACT

A socket plug for attachment to a lighting fixture by means of rotation includes a body portion for receiving a bulb, a handle portion attached to the body portion, wherein the body portion is integrally formed of substantially axially aligned portions, namely, a bulb attachment portion, a lighting fixture attachment portion, and a handle attachment portion to which the handle portion is attached. Electrical conductors supply electricity to a bulb and are guided outwards through an end portion of the handle attachment portion, the handle portion is integrally formed of a coupling portion coupled to the handle attachment portion of the body portion and a conductor retaining portion for retaining the electrical conductors.

15 Claims, 4 Drawing Sheets

PRIOR ART

SOCKET PLUG

This application claims the benefit of Japanese Patent Application No. 98-20863, filed in Japan on Feb. 2, 1998, which is hereby incorporated by reference.

BACKGROUND OF THE INVENTION

1. Field of the Invention

The present invention relates to a novel socket plug, more specifically, to a socket plug that can be easily attached to a lighting fixture, can be manufactured at low cost, and affords suitable accommodation for electrical conductors.

2. Description of the Related Art

As an example of a socket plug that is attached to a lighting fixture by means of rotation, there is provided a straight-type socket plug, which is integrally formed of substantially axially aligned portions, namely, a bulb attachment portion to which the bulb is attached, a lighting fixture attachment portion attached to a lighting fixture, and a rear end portion to which connectors are attached or through which electrical conductors are guided outwards. It is not easy to apply a force to such a socket plug when the socket plug is attached to or detached from the lighting fixture, which causes a problem of deterioration in workability.

To solve the problem, a socket plug "a" shown in FIG. 6 has been proposed. The socket plug "a" is integrally formed of a bulb attachment portion "b", a lighting fixture attachment portion "c" coupled to the rear end of the bulb attachment portion "b", and a connector portion "d" coupled to the rear end of the lighting fixture attachment portion "c". The bulb attachment portion "b" and the lighting fixture attachment portion "c" are axially aligned with each other. The connector portion "d" corresponds to a rear end portion of the socket plug "a". The connector portion is substantially L-shaped in a side view. A laterally protruding portion "e" has a recess portion (not shown) opening to an end face. Electrical conductor terminals are disposed within the recess portion.

Thus, in attaching the aforementioned socket plug "a" to the lighting fixture, a sufficient rotational force can be applied to the socket plug "a" by taking a grip on the substantially L-shaped connector portion "d", especially the laterally protruding portion "e". Accordingly, the socket plug "a" can be easily attached to or detached from the lighting fixture. However, the aforementioned socket plug "a", which is equipped with the L-shaped connector portion "d", is complicated in shape and thus requires high molding costs. Besides, the electrical conductor terminals cannot be disposed within the recess portion without adopting so-called insert molding, which causes a further increase in costs.

SUMMARY OF THE INVENTION

An object of the present invention is a socket plug that substantially obviates one or more of the problems due to limitations and disadvantages of the related art.

Another object of the present invention is a socket plug that can be easily attached to a lighting fixture, can be manufactured at low cost, and affords suitable accommodation for electrical conductors.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a socket plug for rotatable attachment to a lighting fixture comprises a body portion for receiving a bulb, a handle portion attached to the body portion, the body portion including integrally formed, substantially axially aligned bulb attachment, lighting fixture attachment, and handle attachment portions, and electrical conductors for supplying electricity to a bulb upon attachment of a bulb to the bulb attachment portion, the electrical conductors being guided outwards through an end portion of the handle attachment portion, the handle portion being integrally formed of a coupling portion coupled to the handle attachment portion of the body portion and a conductor retaining portion for retaining the electrical conductor .

BRIEF DESCRIPTION OF THE DRAWINGS

The accompanying drawings, which are included to provide a more complete understanding of the invention and are incorporated in and constitute a part of this specification, illustrate the invention and together with the description serve to explain the principles of the invention. In the drawings.

DETAILED DESCRIPTION OF THE PREFERRED EMBODIMENT

Figure 1:
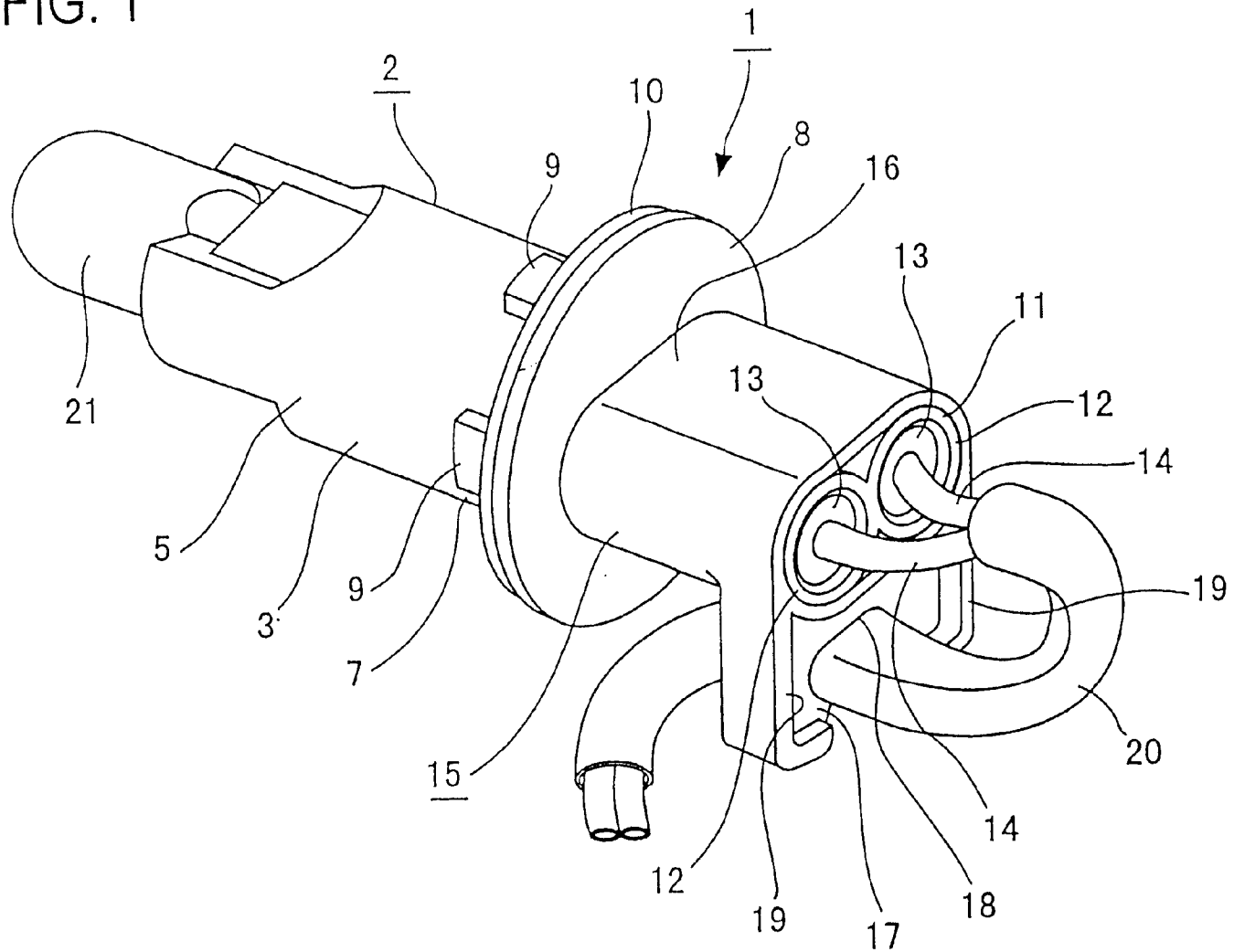
FIG. 1 is a perspective view of a socket plug according to the present invention showing a state where respective portions of the socket plug are coupled to one another.
Figure 2:
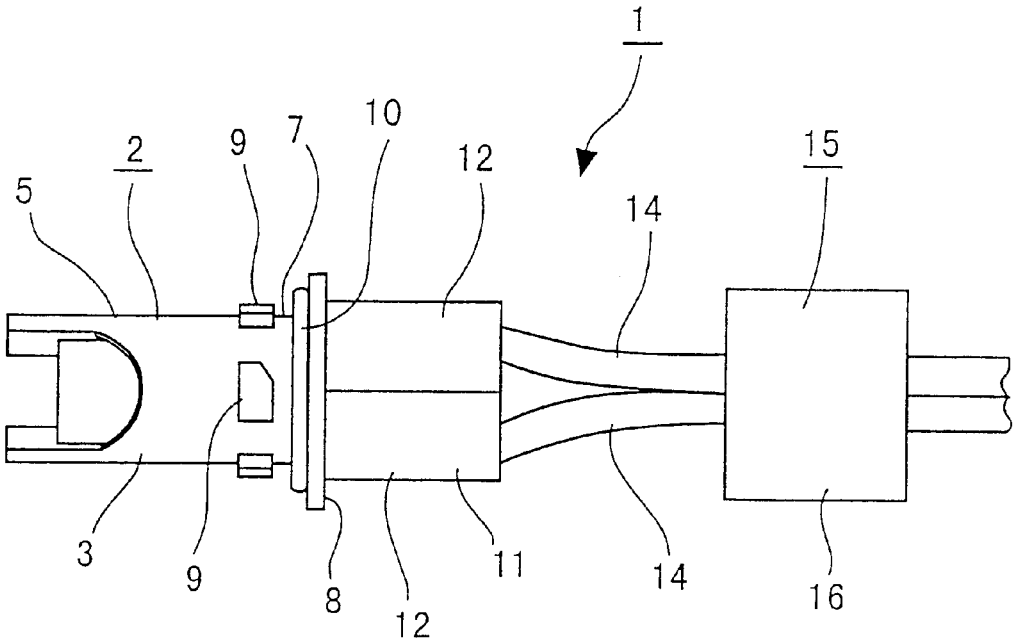
FIG. 2 is a plan view of a socket plug according to the present invention showing the respective portions separately.
Figure 3:
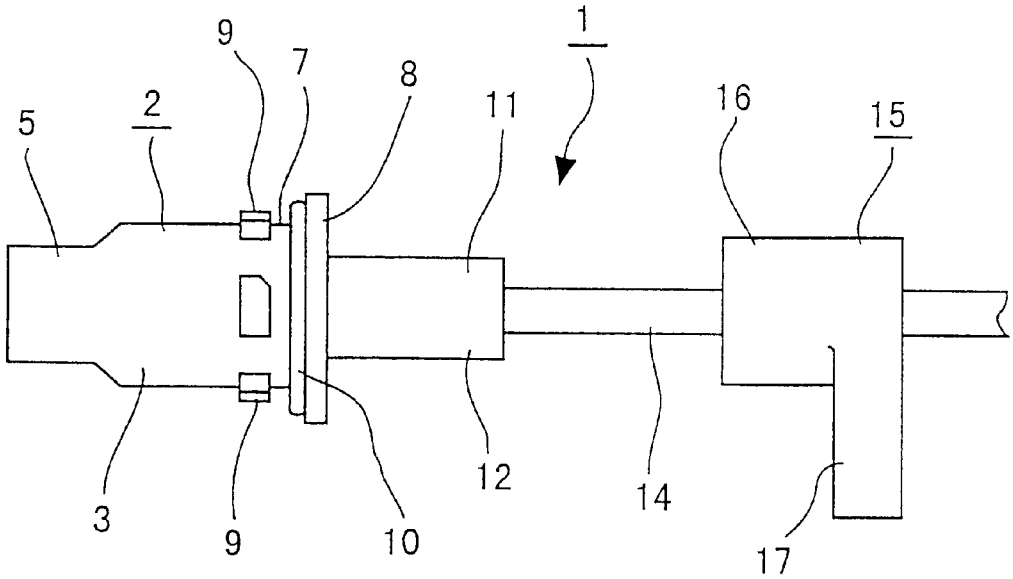
FIG. 3 is a side view of a socket plug according to the present invention showing the respective portions separately.
Figure 4:
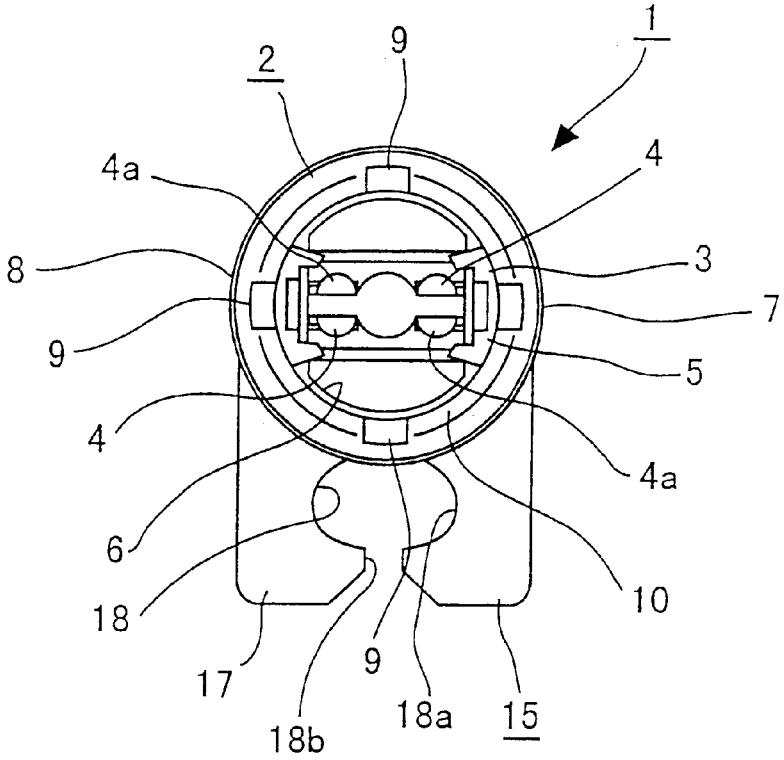
FIG. 4 is a front view of a socket plug according to the present invention showing the respective portions in a coupled state.
Figure 5:
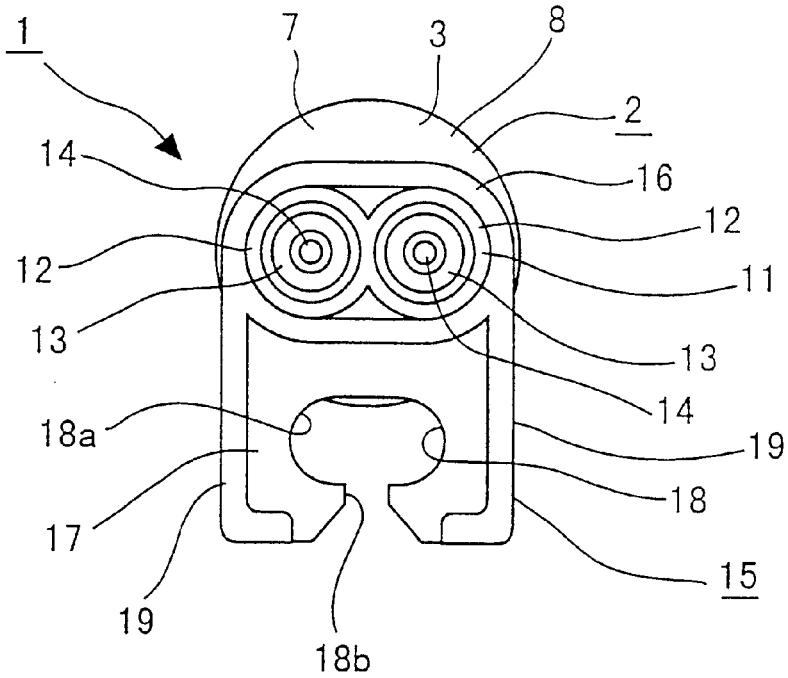
FIG. 5 is a rear view of a socket plug according to the present invention showing the respective portions in a coupled state.
Figure 6:
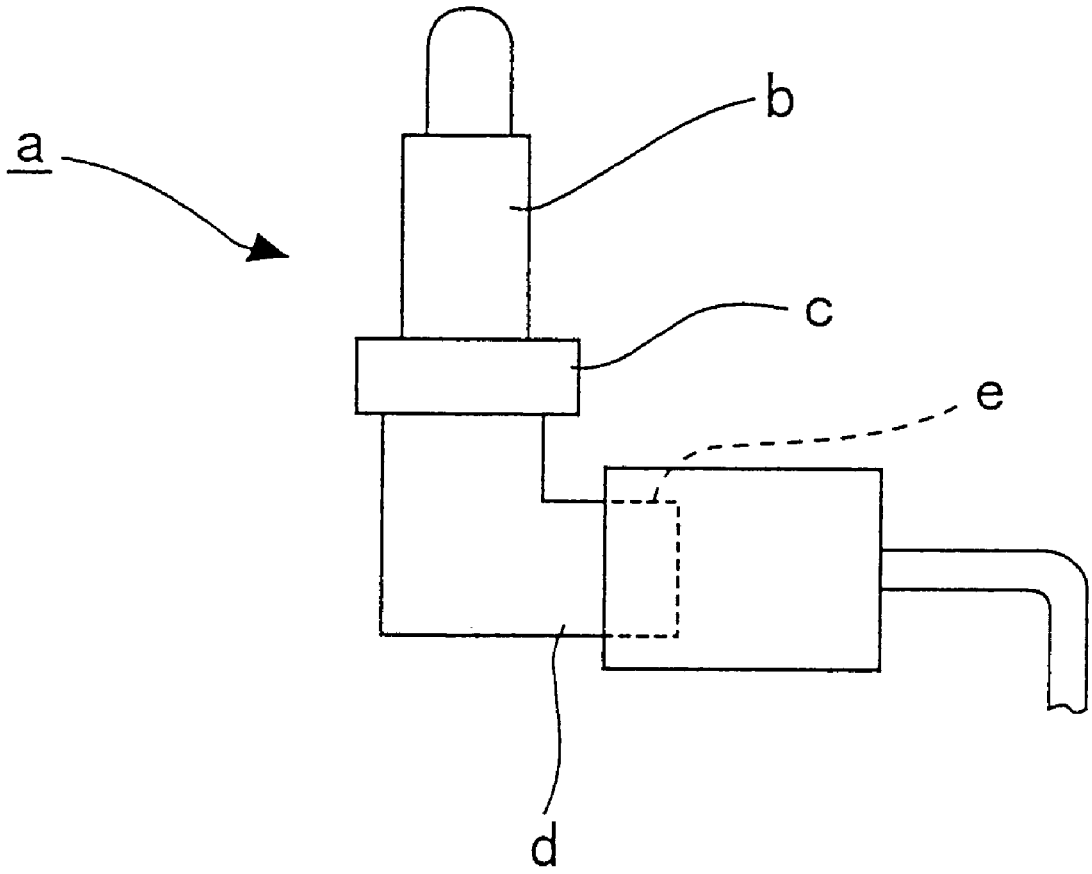
FIG. 6 is a side view showing an example of a conventional socket plug.

The socket plug of the present invention includes a body portion integrally formed of substantially axially aligned portions, namely, a bulb attachment portion to which a bulb is to be attached, a lighting fixture attachment portion attached to the lighting fixture, and a handle attachment portion to which the handle portion is attached. Electrical conductors for supplying electricity to the bulb are guided outwards through an end portion of the handle attachment portion. The handle portion is integrally formed of a coupling portion coupled to the handle attachment portion of the body portion and a conductor retaining portion for retaining the aforementioned electrical conductors. The handle portion is substantially L-shaped.

The socket plug according to the present invention can be easily rotated by taking a grip on the substantially L-shaped handle portion, making the operation of attaching the socket plug to the lighting fixture easy to perform. Also, since the respective portions constituting the body portion are substantially axially aligned with one another, the body portion can be manufactured with ease. For example, the separately formed electrical conductor terminals can be integrated with the body portion. Moreover, since the handle portion is provided with the conductor retaining portion, it is possible to restrict a path along which the electrical conductors are arranged.

An embodiment of a socket plug according to the present invention will be described with reference to the accompanying drawings. The socket plug 1 is composed of a body portion to which a bulb is to be attached and a handle portion attached to the body portion The body portion 2 is composed of an outer shell portion 3 made of a plastic material and electrical conductor terminals 4 disposed within the outer shell portion 3. The body portion is integrally formed of substantially axially aligned portions, namely, a bulb attachment portion to which a bulb is to be attached, a lighting fixture attachment portion to be attached to a lighting fixture, and a handle attachment portion to which the handle portion is attached. The bulb attachment portion 5 includes the outer shell portion 3, which is substantially cylindrical and has a recess portion 6 opening forwards. Bulb receiving portions 4*a* of the electrical conductor terminals 4 are disposed within the recess portion 6.

The lighting fixture attachment portion 7 is formed as part of the outer shell portion 3. A circular flange portion 8 is formed at a rear end of a cylindrical section of the bulb attachment portion 5 that continuously extends from the rear end of the outer shell portion 3. A plurality of engaging protrusions 9 are protrusively formed slightly forward of the flange portion 8.

The attachment of the lighting fixture is carried out in the following manner. First, a section of the lighting fixture attachment portion that is located forward of the flange portion 8 is inserted through an attachment hole that has notches of the lighting fixture corresponding to the aforementioned engaging protrusions 9. The lighting fixture and the lighting fixture attachment portion are integrally rotated so that the flange portion 8 and the engaging protrusions 9 sandwich an edge of the aforementioned attachment hole. In this construction, a ring-like packing 10 is fitted to the front face of the flange portion 8. Hence, the packing 10 is compressed between the flange portion 8 and the edge of the attachment hole, whereby secure attachment and good waterproofness can be achieved.

The handle attachment portion 11 is formed as part of the outer shell portion 3. The handle attachment portion 11 includes two cylinders 12 protruding rearwards from the rear face of the flange portion 8. One of the cylinders 12 is connected at its lateral portion with the other. The inner spaces of the cylinders 12 are in communication with the recess portion 6 of the bulb attachment portion 5.

Rubber bushings 13 are fitted in the cylinders 12 of the handle attachment portion 11. Electrical conductors 14, which are connected with the aforementioned electrical conductor terminals 4, are inserted through the rubber bushings 13 and guided outwards through the rear ends of the cylinders 12.

The handle portion 15 is formed as an integral component made of a plastic material, which component is composed of a coupling portion and a conductor retaining portion. The coupling portion 16 is in the shape of an elliptic cylinder. The conductor retaining portion 17, which is substantially in the shape of a plate, protrudes downwards from the rear end of the coupling portion 16. Hence, the handle portion 15 is substantially L-shaped.

A substantially keyhole-shaped retention hole 18 is formed in the conductor retaining portion 17 at one end. The retention hole 18 opens at an edge of the conductor retaining portion 17 opposite to the end that is coupled to the coupling portion 16. A large-diameter portion 18*a* of the retention hole 18 serves as an insertion retainment portion through which the electrical conductors 14 are inserted. A small-diameter portion 18*b*, which is formed at the opening end of the retention hole 18, serves as a drop-off preventing portion.

Each of reinforcement ribs 19 extends from a side edge to one end edge of the rear face of the conductor retaining portion 17. The coupling portion 16 of the handle portion 15 is securely fitted onto the handle attachment portion 11 of the aforementioned body portion . In this case, the electrical conductors 14 are inserted through the coupling portion 16 and are guided outwards through the rear end thereof. An elastic tube 20 is fitted onto sections of the electrical codes 14 that are guided outwards through the coupling portion 16, and binds those sections together, which are then inserted through the insertion retainment portion 18*a* of the conductor retaining portion 17. Once the electrical conductors 14 have been inserted through the insertion retainment portion 18*a*, there is no possibility of the electrical conductors 14 dropping out of the insertion retainment portion 18*a*, because the diameter of the tube 20 is larger than the width of the drop-off preventing portion 18*b*. Unless the tube 20 is crushed enough to be passed through the drop-off preventing portion 18*b*, the electrical conductors 14 will not drop out of the insertion retainment portion 18*a*.

A base portion of a bulb 21 can be inserted into the recess portion 6 of the bulb attachment portion 5, so that the bulb 1 is retained by the bulb receiving portions 4*a*, of the electrical conductor terminals 4 and connected with the electrical conductors 14 via the electrical conductor terminals 4.

When the aforementioned socket plug is attached to or detached from the lighting fixture, a rotational force is applied thereto by taking a grip on the handle portion 15, especially the conductor retaining portion 17. This makes it easy to apply a rotational force to the socket plug 1 and allows the socket plug 1 to be attached to or detached from the lighting fixture. In addition, the body portion is integrally formed of the respective portions 5, 7 and 11, which are substantially axially aligned with one another. It is therefore easy to manufacture the body portion 2. For example, the separately formed electrical conductor terminals 4 can be integrated with the body portion . Furthermore, since the handle portion 15 is provided with the conductor retaining portion, it is possible to restrict a path along which the electrical conductor are arranged.

In the aforementioned embodiment, the handle attachment portion 11 of the body portion 2 is fitted into the coupling portion 16 of the handle portion 15. However, the handle attachment portion 11 and the coupling portion 16 can be coupled to each other using whatever means, if the means allows separate objects to be coupled to each other with high reliability.

In the case where the handle attachment portion 11 is fitted into the coupling portion 16, unless both the portions have a circular shape, there is no need to provide structure for preventing relative rotation therebetween. Otherwise, it would be necessary to separately provide means for preventing such relative rotation.

As is apparent from what has been described hitherto, the socket plug according to the present invention is attached to a lighting fixture by means of rotation. The socket plug is composed of a body portion to which a bulb is to be attached and a handle portion attached to the body portion. The body portion is integrally formed of substantially axially aligned portions, namely, a bulb attachment portion to which a bulb is to be attached, a lighting fixture attachment portion attached to the lighting fixture, and a handle attachment portion to which the handle portion is attached. Electrical conductors for supplying electricity to the bulb to be attached to the bulb attachment portion are guided outwards through an end portion of the handle attachment portion. The handle portion is integrally formed of a coupling portion coupled to the handle attachment portion of the body portion and a conductor retaining portion for retaining the aforementioned electrical conductors. The handle portion is substantially L-shaped.

The socket plug of the present invention can be rotated easily by taking a grip on the substantially L-shaped handle portion. It is therefore easy to attach this socket plug to the lighting fixture. Also, the body portion is integrally formed of substantially axially aligned portions, namely, the bulb attachment portion, the lighting fixture attachment portion and the handle attachment portion. It is therefore easy to manufacture the body portion. For example, the separately formed electrical conductor terminals can be integrated with the body portion. Furthermore, since the handle portion is provided with the conductor retaining portion, it is possible to restrict a path along which the electrical conductors are arranged.

The coupling portion of the handle portion may be tubular, and the coupling portion is securely fitted onto the handle attachment portion of the body portion. Thus, the handle portion can be easily coupled to the body portion. A fitting hole, into which the handle attachment portion is fitted, may have a non-circular shape in cross-section. Therefore, there is no need to provide structure for preventing relative rotation between the handle attachment portion and the coupling portion. The overall structure is simplified.

The socket plug has an insertion retainment portion through which the electrical conductors are inserted and are retained. A drop-off preventing portion prevents the electrical conductors from dropping out of the insertion retainment portion. Therefore, the electrical conductors can be securely retained by the insertion retainment portion.

It will be apparent to those skilled in the art that various modifications and variations can be made in the socket plug of the present invention without departing from the spirit or scope of the invention. Thus, it is intended that the present invention cover the modifications and variations of this invention provided they come within the scope of the appended claims and their equivalents.

What is claimed is:

1. A socket plug for rotatable attachment to a lighting fixture, comprising:

a body portion for receiving a bulb, the body portion including bulb attachment, lighting fixture attachment, and handle attachment portions, which are substantially axially aligned and integrally formed into a single-piece;

electrical conductors for supplying electricity to the bulb attached to the bulb attachment portion, the electrical conductors being guided outwards through an axial end portion of the handle attachment portion; and a handle portion attached to the body portion, the handle portion being integrally formed of a coupling portion coupled to the handle attachment portion of the body portion and a conductor retaining portion for retaining the electrical conductors.

2. The socket plug according to claim 1, wherein the handle portion is substantially L-shaped.

3. The socket plug according to claim 1, wherein the coupling portion of the handle portion is tubular and is fitted onto the handle attachment portion of the body portion.

4. The socket plug according to claim 3, the handle portion further including a fitting hole for receiving the handle attachment portion therein.

5. The socket plug according to claim 4, wherein the fitting hole has a non-circular cross-section.

6. The socket plug according to claim 3, wherein the socket plug has an insertion retainment portion for receiving and retaining the electrical conductors and a drop-off preventing portion for preventing the electrical conductors from dropping out of the insertion retainment portion.

7. The socket plug according to claim 4, wherein the socket plug has an insertion retainment portion for receiving and retaining the electrical conductors and a drop-off preventing portion for preventing the electrical conductors from dropping out of the insertion retainment portion.

8. A socket plug for rotatable attachment to a lighting fixture, comprising:

a body portion for receiving a bulb, the body portion including bulb attachment, lighting fixture attachment, and handle attachment portions, which are substantially axially aligned and integrally formed into a single-piece;

electrical conductors for supplying electricity to the bulb attached to the bulb attachment portion; and a handle portion attached to the body portion, the handle portion being integrally formed of a coupling portion having a fitting hole for receiving the handle attachment portion therein and a conductor retaining portion for retaining the electrical conductors.

9. The socket plug according to claim 8, wherein the socket plug has an insertion retainment portion for receiving and retaining the electrical conductors and a drop-off preventing portion for preventing the electrical conductors from dropping out of the insertion retainment portion.

10. The socket plug according to claim 9, wherein the handle portion is substantially L-shaped.

11. A socket plug for rotatable attachment to a lighting fixture, comprising:

a body portion for receiving a bulb, the body portion being integrally formed of substantially axially aligned bulb attachment, lighting fixture attachment, and handle attachment portions;

electrical conductors for supplying electricity to a bulb attached to the bulb attachment portion, the electrical conductors being guided outwards through an end portion of the handle attachment portion; and a substantially L-shaped handle portion, the substantially L-shaped handle portion including a fitting hole for receiving the handle attachment portion therein, and being integrally formed of:

a coupling portion, wherein the coupling portion is tubular and is fitted onto the handle attachment portion of the body portion, and a conductor retaining portion for retaining the electrical conductors.

12. The socket plug according to claim 11, wherein the fitting hole has a non-circular cross-section.

13. The socket plug according to claim 11, wherein the socket plug has an insertion retainment portion for receiving and retaining the electrical conductors and a drop-off preventing portion for preventing the electrical conductors from dropping out of the insertion retainment portion.

14. The socket plug according to claim 11, wherein the coupling portion has the fitting hole for receiving the handle attachment portion therein.

15. The socket plug according to claim 12, wherein the coupling portion has the fitting hole for receiving the handle attachment portion therein.

* * * * *